US005484004A

United States Patent [19]

Bolz

[11] Patent Number: 5,484,004

[45] Date of Patent: Jan. 16, 1996

[54] TRANSFER CLOSURE VALVE FOR FILLING AND EMPTYING CONTAINERS

[75] Inventor: Alfred Bolz, Wangen im Allgäu, Germany

[73] Assignee: Alfred Bolz GmbH & Co. KG, Wangen, Germany

[21] Appl. No.: 112,941

[22] Filed: Aug. 30, 1993

[30] Foreign Application Priority Data

Sep. 18, 1992 [DE] Germany ..... 9212623 U

[51] Int. Cl.[6] ..... B65B 1/04

[52] U.S. Cl. ..... 141/346; 141/319; 141/321; 141/354; 414/217

[58] Field of Search ..... 141/319, 320, 141/321, 346, 348, 351, 352, 354, 357, 364, 375; 414/217, 219, 221

[56] References Cited

U.S. PATENT DOCUMENTS

| | | | |
|---|---|---|---|
| 1,770,576 | 7/1970 | Leather | 141/321 X |
| 4,752,807 | 6/1988 | Mort | 141/319 X |
| 4,942,432 | 7/1990 | Mort et al. | 141/346 X |
| 5,086,818 | 2/1992 | Bendt | 141/354 X |
| 5,125,438 | 6/1992 | McCunn et al. | 141/346 X |
| 5,144,992 | 9/1992 | Jaeger et al. | 141/346 |
| 5,263,521 | 11/1993 | Brossand et al. | 141/346 X |

*Primary Examiner*—Ernest G. Cusick
*Attorney, Agent, or Firm*—Brown, Martin Haller & McClain

[57] ABSTRACT

There is disclosed a transfer closure valve for safely filling and emptying containers of any type with a liquid, pasty or powdery medium. The medium flows from a barrel into another container without escaping into the environment. The closure valve has a first housing in which is arranged a rotatable or slidable second housing which is fixed to a filler pipe. The second housing is provided with a lifting mechanism for lifting and lowering a lifting cap which opens or closes a lower outlet opening of the first housing. In a first position of the second housing the lifting cap closes the outlet opening, whilst in a second position of the second housing the filler pipe is brought into register with an upper connecting piece of the first housing and the lower outlet opening of the first housing.

8 Claims, 6 Drawing Sheets

TRANSFER CLOSURE VALVE FOR FILLING AND EMPTYING CONTAINERS

FIELD OF THE INVENTION

This invention relates to a transfer closure valve for filling and emptying containers, especially for filling a barrel with a material, for example, a powder, a liquid or a pasty material, from another container The closure valve comprises a housing having an upper connecting piece for docking with a container, a lower connecting piece being arranged coaxially with, and opposite to, the upper connecting piece. The housing contains a movable member for moving sealing elements associated with the connecting pieces into a closed or an open position. In the open position of the sealing elements a flow connection is produced between the upper and the lower connecting piece. The containers may be of all types.

Such a transfer closure valve may be part of a safety system by means of which containers can be filled and/or emptied safely, for example in the chemical and pharmaceutical industry. The containers may for example include conical dryers, barrels or containers having closure means which cooperate with the transfer valve with the aid of a lifting device. An object of the invention is to ensure that material, which may for example be injurious does not reach the environment. In the following discussion a container to be filled and/or emptied, will be referred to simply as a "barrel".

BACKGROUND OF THE INVENTION

Evidence suggests that known transfer closure valves do not prevent material, for example, powder from being undesirably discharged into the environment.

In a known type of transfer valve, a so-called "double door principle" is employed, in which a barrel to be filled or emptied is closed by a lid which is rotatable through a given angle. The barrel with the lid secured thereto is mounted on the transfer valve and is then placed in position and rotated, causing the lid of the barrel to be released. A lid of the valve and the lid of the barrel, are then pivoted out together, the transfer valve is then opened and a filler pipe is then passed through the transfer system causing the material in the barrel to be transferred through the opened transfer system into another barrel.

A disadvantage of the known system referred to above is that the barrel must be rotated for docking with the transfer valve, with the danger of wear and tear on the sealing means, so that with repeated use, the tightness of the sealing can no longer be guaranteed.

Also, the expense of providing the mechanical means needed for docking and rotation of the barrel to be filled or emptied, is relatively high. Especially where the barrel is large and heavy it is undesirable for the barrel first to be raised and then to be rotated through an angle of, for example, 60° C. in order to achieve the docking and opening of the transfer valve. Further, the friction generated by the surfaces rubbing against each other can cause particles to be released undesirably into the environment. At the same time the problem arises of particles which are released as a result of said surfaces rubbing against each other, getting into the product, with which a barrel is to be filled, so that it is undesirably soiled.

It is therefore an object of the present invention to provide a transfer closure valve of the type mentioned in the first paragraph of this specification, with which hazardous materials can be more safely transferred and with substantially less expensive mechanical means.

SUMMARY OF THE INVENTION

According to the present invention the movable member is constructed as a second housing, slidably or rotatably arranged in the first housing and which has a lifting device for moving a lifting cap onto the connecting piece of a barrel, there being connected to the housing, a filler pipe which is placed in the appropriate displacement or rotational position of the second housing and produces a flow connection between the upper connecting piece and the lower outlet opening of the housing.

By virtue of the present invention, a barrel docking with the transfer valve need not be rotated, the lid of the barrel being pressed against the transfer closure valve in the direction of the longitudinal axis of the barrel. A lid raising mechanism lifts the barrel lid from the barrel and moves it away laterally through the filler opening or the outlet opening of the barrel in order thereby to free the opening of the barrel and thus to safely dock the barrel with an emptying or filling system.

Instead of the barrel being rotated, in the known manner, the second housing is slid or rotated approximately perpendicularly to the filling direction, that is to say the axis of the barrel.

A system is known which comprises two laterally movable slides operating independently of each other. For coaxial alignment with the longitudinal axis of the barrel the first slide moves a filler piece or a filler pipe in the transfer valve, whilst a second slide moves the lid of the barrel laterally from the filling region (outside the longitudinal axis of the barrel). According to the present invention, the high constructional cost of this known system is avoided by providing the single, unitary second housing, a lifting system which carries out a movement coaxially with the barrel axis and perpendicularly to the lifting movement the second housing then moves the lid of the barrel out of the barrel axis in a direction perpendicular thereto. Since the docking barrel need not be rotated, the sealing means need not be closed, so that the danger of sealing particles soiling the product concerned is removed.

The present invention therefore provides an X-Y system which operates in two directions which are perpendicular to each other. During the lateral displacement of the second housing the filler pipe is brought into position, thus avoiding the need for a second slide to operate independently thereof. As mentioned above the second housing may be rotary instead of being transversely displaceable.

DETAILED DESCRIPTION OF THE PREFERRED EMBODIMENTS OF THE INVENTION

Figure 1:
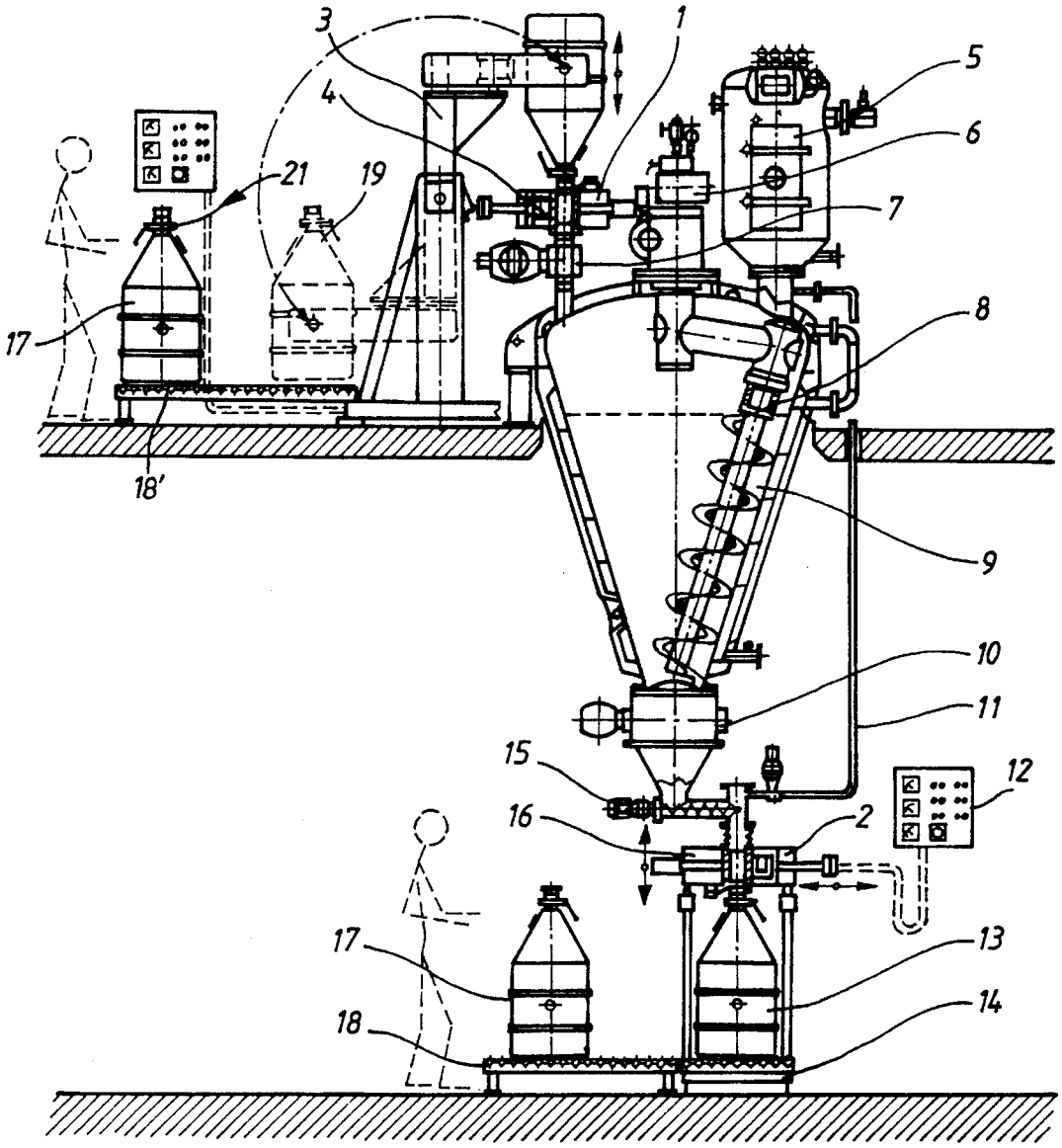
FIG. 1 is a schematic diagram of a powder transfer system having closure valves according to a preferred embodiment of the invention.

FIG. 1 shows, by way of example, a transfer system for emptying and filling containers. In the example of FIG. 1 each container is a barrel for containing a powdery medium. As shown in FIG. 1 a filled barrel 17 is supplied by means of a roller conveyor 18' to a barrel lifting system 3 for grasping the barrel 17 and turning it over as indicated by the arrow A, so that the outlet opening 19 of the barrel 17 points downwards.

The opening 19 of the barrel 17 is closed by means of a closure 21 which essentially consists of a clamping ring 23 (FIG. 2) which keeps a safety lid 24 in position on the barrel 17. The outlet opening 19 is further closed by a flap valve 20 operated by a closure lever 22. In the space intermediate the safety lid 24 and the flap valve 20 is a barrel lid 25 which is sealingly seated on a barrel counter flange in the region of the outlet opening 19.

As described below, the barrel lid 25 is then opened and moved away by a transfer closure valve 1 according to the preferred embodiment of the invention.

First, the safety lid 24 is removed from the barrel 17 before it is turned over by the barrel lifting system 3. The barrel lid 25 is then positioned next to the outlet opening 19 beneath which is the closure 21 which remains closed.

The barrel 17 is placed by the barrel lifting system 3 onto a barrel emptying means 4 part of which is the closure valve 1. When the closure valve 1 is open, the contents of the barrel is emptied into a known vacuum dryer/mixer 9 having a vapour filter 5, and a drive unit 6 for providing rotary drive for a pharma screw 8. Egress of the powdery medium from the barrel 17 by way of the transfer closure valve 1, when it is open, can only take place when shut-off valve 7 is open.

Figure 18:
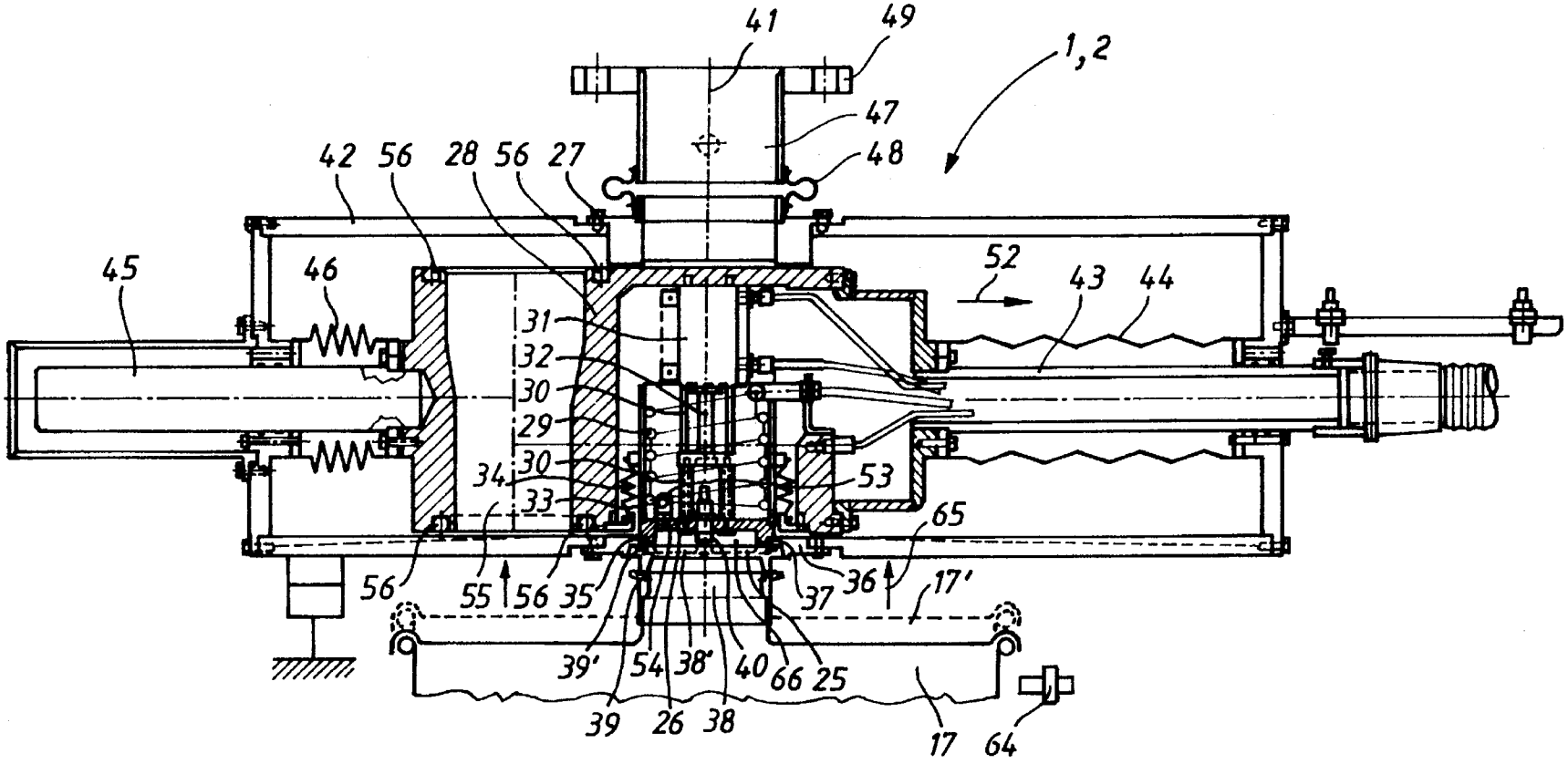
FIG. 18 is a side view shown partly in section, of said closure valve.

The outlet of the vacuum dryer/mixer 9 is provided by a ball valve 10, in which said medium is discharged by way of metering screw 15 and is poured through a barrel filler 16 into an empty barrel which has been docked and is referenced 13. The docked barrel 13 stands on a weighing system 14 for removal by a roller conveyor 18 from which it can be taken as a filled barrel 17 and subjected to further processing. The vacuum dryer/mixer 9 also has a pressure equalising pipe 11 extending from the metering screw 15 to the interior of the mixing container. The transfer system is controlled by way of control panels 12. A second transfer closure valve 2 controls filling of empty barrel 13. Closure valve 2 acts as a filler valve and is identical to valve 1, which acts as a discharge valve, but is located in an inverted position relative to discharge valve 1. FIGS. 2–9 illustrate operation of the valve as a discharge valve 1 while FIGS. 10–17 illustrate operation of the valve in its inverted position as a filler valve 2. FIG. 18 illustrates the transfer closure valve in an inverted position in which it operates as a filler valve 2. However, it will be understood that the sequence of movements described below apply equally to the discharge valve 1 when operated in an inverted position relative to the position illustrated in FIG. 18, as well as to the filler valve in the orientation illustrated in FIG. 18, and the same reference numerals are used for the corresponding parts of the discharge valve 1 and filler valve 2.

The preferred embodiment of the closure valve, will now be described with reference to FIG. 18, which illustrates the valve in its filler position 2. The following description, however, applies equally to the valve when in its discharge position 1, in which case it will be inverted relative to FIG. 18 and the barrel 17 will initially be full rather than empty.

The closure valve 1 or 2 comprises a central bore 27 in a displaceable housing 28 in a fixed housing 42. As shown in FIG. 18, a lifting cap 26 is connected to a pipe 33 which is held through a bellows 34 sealingly and elastically against the housing 28 of the valve. Within the pipe 33 is a pipe 29 for the supply of compressed air to a cylinder 31 having a piston rod 32. The pipe 33 is of larger diameter than the cylinder 31 and can thus be positioned over the cylinder 31 during the inward stroke of the piston rod 32. The lifting cap 26 is connected by way of levers 30 to the piston rod 32. The lifting cap 26 further has a lower and outer seal 35 through which the lifting cap 26 rests sealingly against a housing flange 36 of the housing 28. The barrel 17 accordingly has a barrel connecting piece 38 having on its front face an upper peripheral seal 39. In FIG. 18 the barrel connecting piece 38 is shown with its seal 39 in two different positions, namely in a position referenced 38'and in a lowered position. In the raised position of the seal, referenced 39', it rests sealingly against frusto-conical seal 35 of the lifting cap 26, thereby providing a sealing surface 37. There is fitted to the lifting cap 26 a proximity sensor switch 40 which is connected to a corresponding sensor line. The switch 40 is arranged to prevent the cylinder 31 from being activated when there is no barrel connecting piece 38 docked in its raised position.

A channel may be arranged in the housing flange 36 in its region radially outward of the seal 35, for receiving compressed air, said channel resting sealingly on the barrel connecting piece 38 and serving to indicate whether the barrel connecting piece 38 rests tight against the housing flange 36. The escape of compressed air from said channel indicates that the system is not sealed and the lid lifting system is then locked.

The entire lifting system, comprising the cylinder 31, the piston rod 32 and the lifting cap 26, is part of said displaceable housing 28 which is movable back and forth in housing 42 perpendicularly to the barrel axis 41 as indicated bay row 52. To this end the housing 28 is engaged on one side by a guide rod 43 covered radially outwardly thereof by a bellows 44. On the opposite side of the housing 28 is a similar guide rod 45 which is covered within the housing 42 by a radially outer bellows 46. The guide rod 43 is displaced from outside the housing 42 by a pneumatic cylinder (not shown) flanged to the exterior of the housing 42, the guide rod 43 being part of the piston rod of said cylinder. Said cylinder may be replaced by a toothed rack drive means or electromagnetic drive means, for example. The guide rods 43 and 45 need not be arranged in axial alignment, as shown, but may engage the housing 28 at positions laterally displaced from each other.

Figure 2:
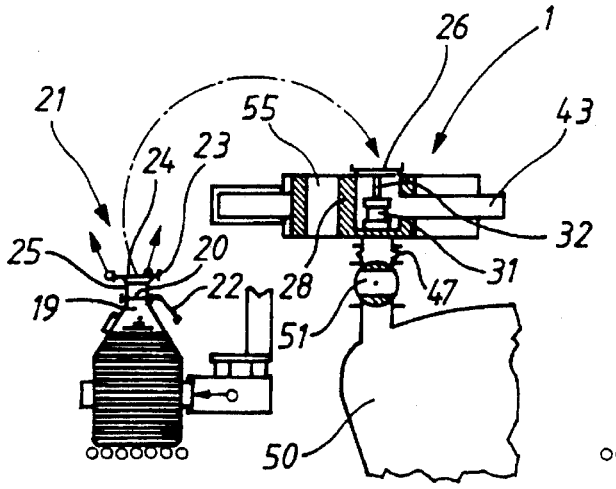
FIGS. 2 to 9 are fragmentary side views shown partly in section, illustrating respective consecutive steps in the emptying of a barrel by means of a first closure valve according to the preferred embodiment of the invention.
Figure 3:
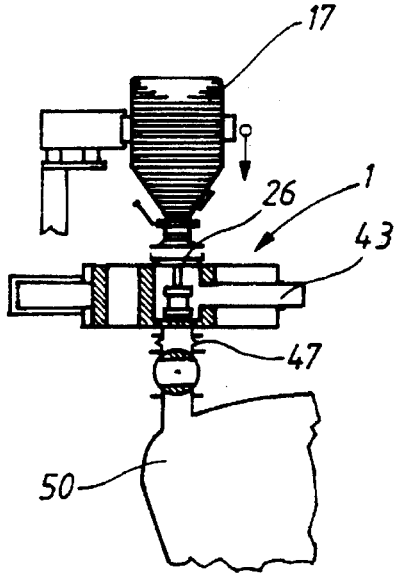

A connecting piece 47 connected to the central bore 27 of the housing 42 serves to connect a container to be filled or emptied to the valve 1 or 2. The connecting piece 47 is a part of the housing 42 and is connected thereto, preferably resiliently, by way of corresponding elastic connections 48. The connecting piece 47 carries a connecting flange 49 which serves as a connection with corresponding screws to a container to be filled or emptied. A container 50 shown in FIG. 2 is in the form of a receptacle or bag. Between the connecting piece 47 and the container 50 is an optional shut-off member 51 or lock system for preventing the escape of harmful material from the container 50 (where it is to contain such material) from entering the closure valve 1. A container to be emptied in FIG. 10 is a conical screw mixer 57 which is secured to connecting piece 47 of the valve in its filler position. Operation of the valve in its discharge position as illustrated in FIGS. 2–9 will first be described in detail.

As described above the entire housing 28 is mounted in the housing 42 for sliding movement in the direction of arrow 52 and in the direction opposite thereto. In the closure position shown in FIG. 18 the housing 28 is not sealed in the housing 42, because when a barrel 17 is connected, the individual sealing surfaces in the lower part (as seen in FIG. 18) of the system are formed by the seals 35 and 39. During transition from the closure position into the opening position, the entire housing 28 is thus moved to the right in the direction of the arrow 52, as shown in FIG. 5.

Figure 4:
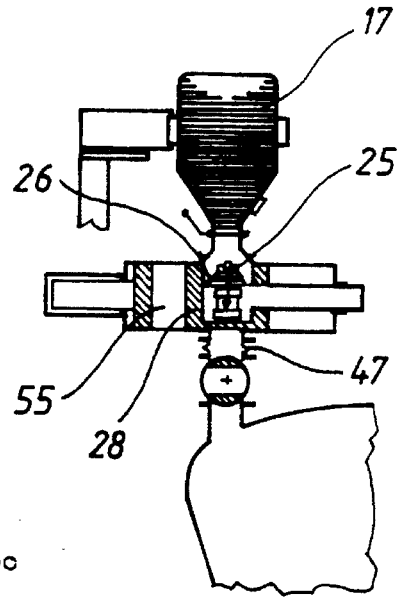

As described above the barrel 17 is initially placed on the valve 1, with the safety lid 24 removed. The lifting cap 26 remains in its full line sealed position, as shown in FIG. 18. During the positioning of the barrel 17 as shown in FIG. 4 the lifting cap 26 is moved downwards by activating the cylinder 31 so that the piston rod 32 is advanced in the cylinder 31. Thereby vacuum is created in a vacuum line extending through the guide rod 43 and connected to vacuum connector 53 (FIG. 18). A vacuum is accordingly produced on the outside of the lifting cap 26 by way of opening 54 and acts on the barrel lid 25 which sealingly adheres to the lifting cap 26. This condition is shown in FIG. 4. Both lids 25 and 26 now travel into the interior of the housing 28 in order subsequently to ensure displacement of the housing 28 into its position 28', as shown in FIG. 5.

Figure 5:
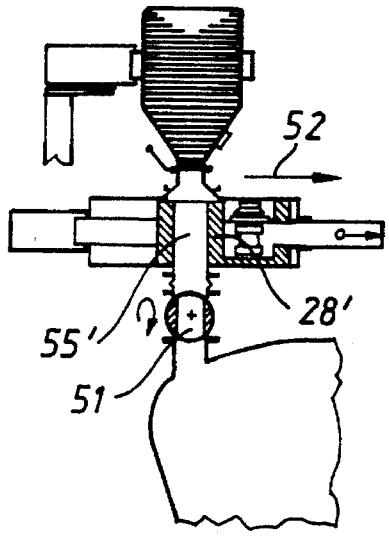

The filler pipe 55 which is part of the housing 28 is now displaced into its position 55' into alignment with the upper connecting piece 47 and is thus simultaneously displaced into alignment with the barrel connecting piece 38, as will be apparent from a comparison of FIGS. 4 and 5.

Figure 6:
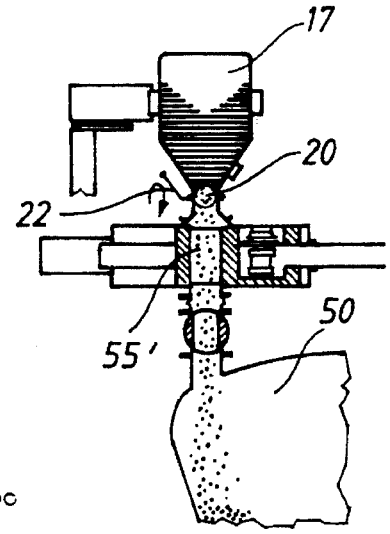

During the displacement of the housing 28 the filler pipe 55 is necessarily also displaced and thus provides a powder flow connection between the barrel 17 to be emptied and the container 50 to be filled. A flow connection is thus provided between the upper connecting piece 47 in the housing 2 and a lower outlet opening 66. As soon as the filler pipe 55 has reached its position 55' in FIG. 5, inflatable front facing seals 56 arranged on the upper and lower front faces of the housing 28 are inflated and thus rest sealingly against the associated inner surfaces of the housing 42 so that the filler pipe is hermetically sealed against the housing 42 and its inner chamber is closed off. A hermetically sealed flow connection is thus produced by the housing 42. As shown in FIG. 5 the shut-off member 51 is then opened and as shown in FIG. 6 the closure lever 22 is opened, causing the flap valve 20 to release the contents of the barrel 17, which flows by way of the connecting piece 47 through the filler pipe 55' downwards through outlet opening 66 into the container 50 to be filled.

Figure 7:
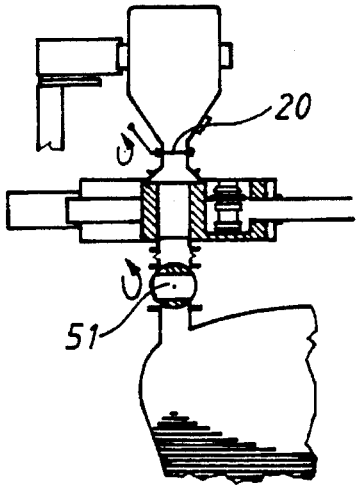
Figure 8:
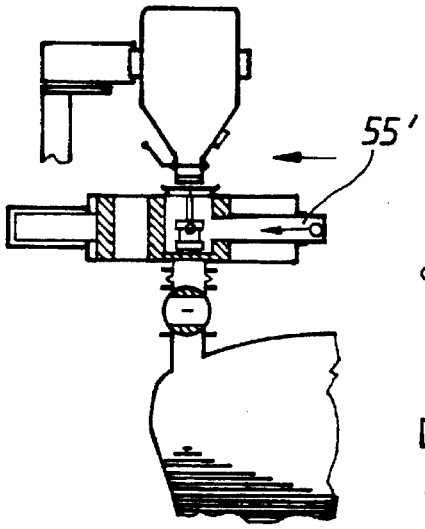

After the container 50 has been successfully filled the flap valve 20 is closed, as well as the shut-off member 52 (FIG. 7). The two inflatable seals 56 of the filler pipe 55 are deflated again and the housing 28 returns leftwardly into its starting position as shown in FIG. 8. The cylinder 31 is activated to raise the piston rod 32 and the barrel lid 25 is placed on the barrel connecting piece 38 which is now in its starting position. The barrel lid 25 is thus held by frictional contact in the region of the barrel connecting piece 38, because it has a radially extending channel in which is located an O-ring which rests against the inside of the barrel connecting piece 38, in sealing and frictional contact with the same. The barrel lid 25 is thus held firmly and positively in the region of the barrel connecting piece 38 and is thus prevented from falling out. The barrel 17 can then be reversed again from its upside down position in FIG. 9 and again placed upright on the roller conveyor 18' corresponding to its starting position in FIG. 2.

Figure 9:
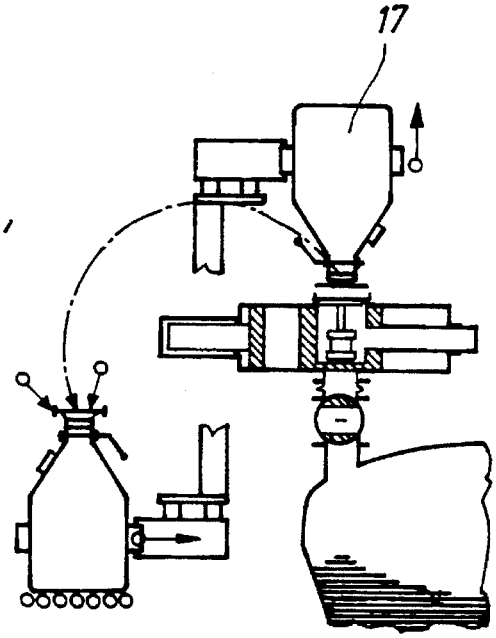
Figure 10:
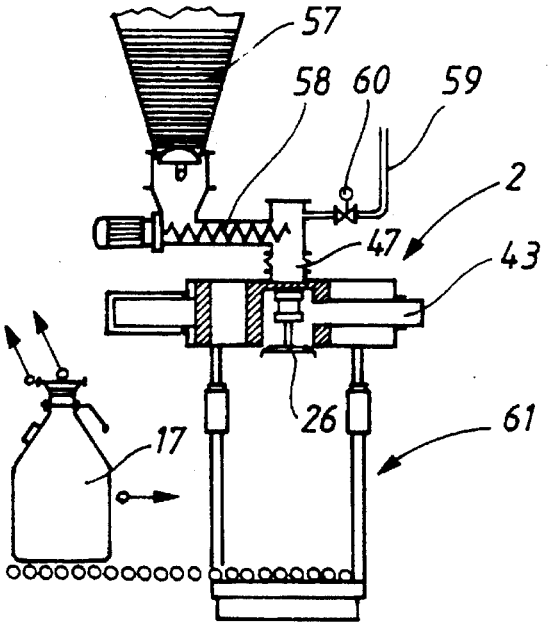
FIGS. 10 to 17 are fragmentary views shown partly in section illustrating respective consecutive steps in the filling of a barrel by means of a second closure valve according to said embodiment.
Figure 11:
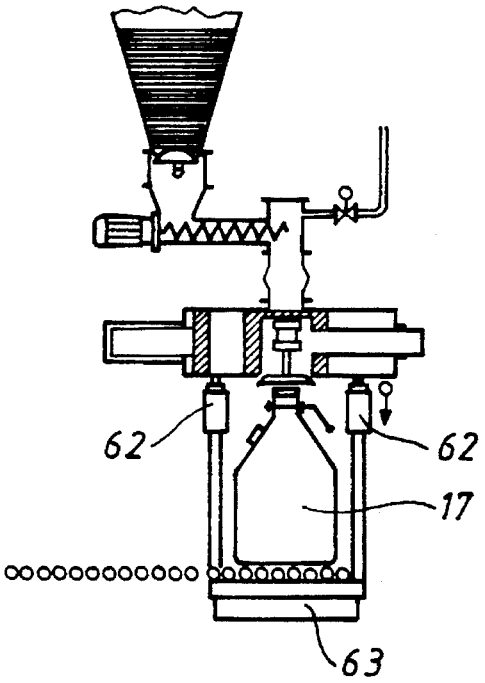
Figure 12:
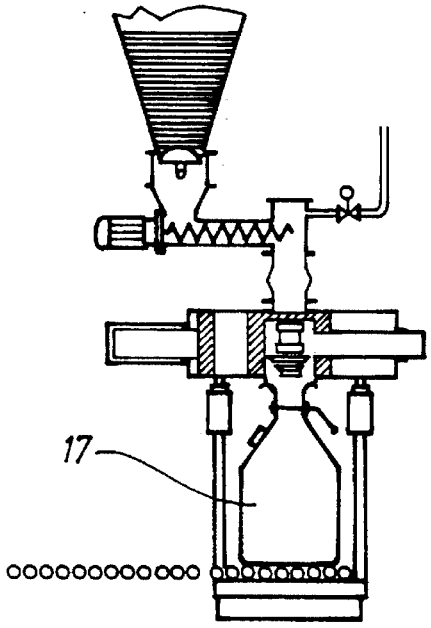
Figure 13:
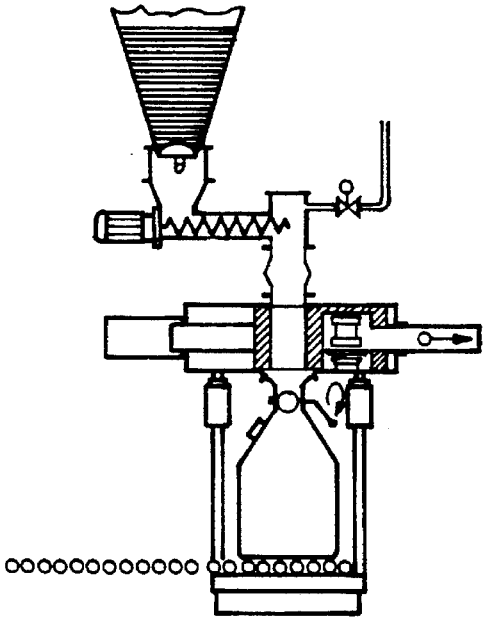
Figure 14:
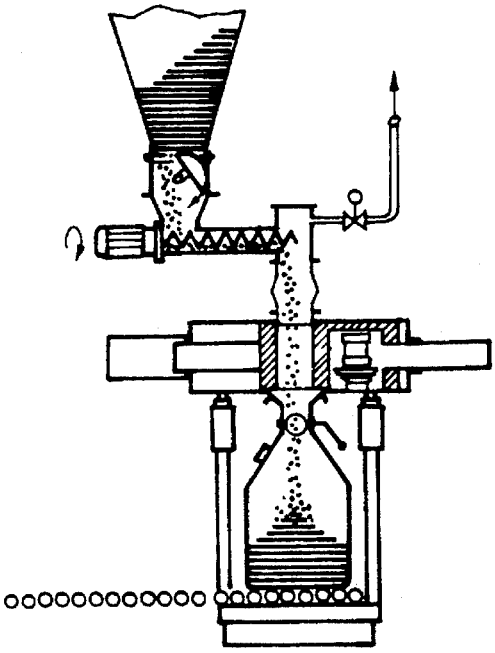
Figure 15:
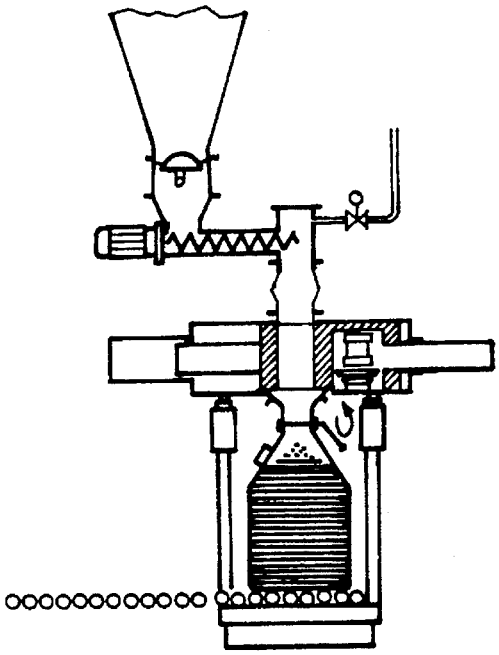
Figure 16:
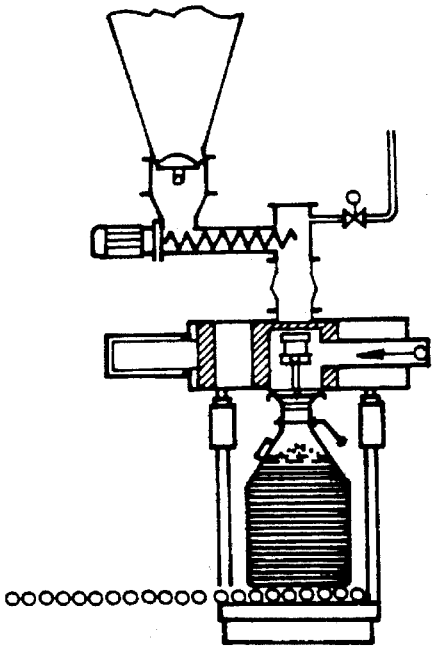
Figure 17:
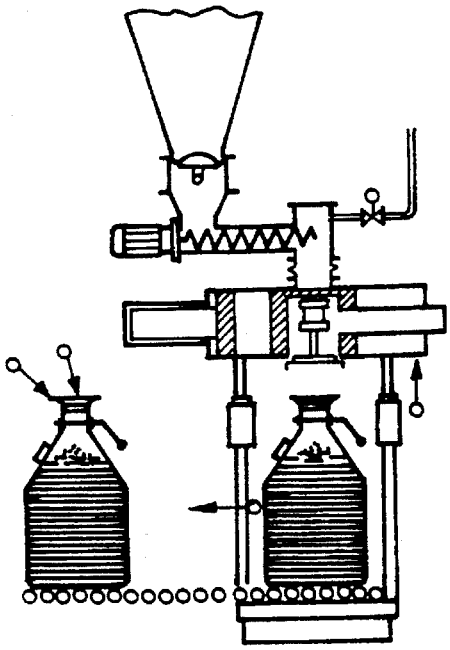

During the transition between the conditions of FIG. 8 and FIG. 9, the vacuum in the space intermediate the lifting cap 26 and the barrel lid 25 is released and this intermediate space is vented in order to ensure that the barrel lid 25 can be fitted by frictional contact against the barrel connecting piece 38 and remain there.

An empty barrel 18 can be filled in an analogous manner, as shown in FIGS. 10 to 17, in which the positions of parts described above bear the same reference numerals as those used above. The valve 2 in FIG. 10 operates as filler valve, whilst the valve 1 of FIG. 1 operates as discharge valve. The sequence of movements described above with reference to the valve 1 also applies, however, to the valve 2, although the valve 2 is inverted with respect to the valve 1.

In the embodiment shown in FIGS. 10 to 17 the contents of a conical screw mixer 57 are conveyed by way of a screw 58 (or other transport means) into the connecting piece 47, in which the volume of air displaced therein is ventilated by way of an air compensating line 59 having a closure valve 60.

A barrel lifting system 61 is provided, onto which the barrel 17 to be filled is transported in the direction of the arrow in FIG. 10. The barrel lifting system 61 has cylinders 62 which act to lift the base 63 of the lifting system 61 so as to press the barrel 17 against the bottom of the valve 2 steps analogous with those described above with reference to FIGS. 2 to 9 then follow.

Although the sliding movements of the housing 28 in the housing 42 are shown herein as being horizontal, said movements may, however, be vertical or diagonal.

Also, instead of the housing 28 being linearly displaceable in the fixed housing 42, the housing 28 may be rotatable in the fixed housing about an eccentric axis which ensures that during such rotation of the housing 28 the filler pipe 55 reaches the region of the central bore 27 of the housing 42.

Instead of the barrel lid 25 being lifted with the aid of a vacuum, the barrel lid 25 may be lifted from the barrel connecting piece 38 by mechanical means, for example by means of a gripper. Provision may also be made for cleaning the seal 39 and the sealing surface 37 with gas or a fluid medium prior to making the sealing connection with the lifting cap. As shown in FIG. 18, a proximity switch 64 is provided for monitoring the lifting of the barrel 17 into the position 17', in the direction of the arrow 65.

What is claimed is:

1. A transfer closure valve for filling and emptying containers, the closure valve comprising:

a first housing having a first, container connecting piece for docking with a container, a second, container connecting piece coaxial with, and opposite to, the first connecting piece; and a movable member inside the first housing movable between a closed position in which there is no connection between the first and second container connecting piece and an open position to produce a flow connection between the first and second connecting piece;

said movable member comprising second housing which is movable in the first housing, a lifting device and a lifting cap mounted in said second housing, said lifting cap comprising means for engagement with a lid of a docked container and said lifting device comprising means for moving said lifting cap onto a said container lid; and a filler pipe being connected to the second housing and being displaceable therewith to produce said flow connection between the first connecting piece and the second connecting piece of the housing, in the open position of the second housing.

2. A transfer closure valve as claimed in claim 1, wherein the second housing is slidable in the first housing.

3. A transfer closure valve as claimed in claim 1, wherein said lifting device comprises a cylinder having a piston rod connected to the lifting cap, said piston rod being movable between a first, extended position in which said lifting cap engages a said container lid and a second, retracted position in which said lifting cap and container lid are retracted into said second housing to open the container.

4. A transfer closure valve as claimed in claim 1, wherein the second housing is drivable linearly in the first housing.

5. A transfer closure valve as claimed in claim 1, wherein a gripper device for picking up a lid of said docked container is provided on the lifting cap.

6. A transfer closure valve as claimed in claim 5, wherein the lifting cap has a vacuum opening for connection to a low pressure system, the vacuum opening comprising the gripper device.

7. A transfer closure valve as claimed in claim 1, wherein the filler pipe which is arranged on the second housing, has front facing inflatable seals for engaging inner surfaces of the second housing coaxially with the first connecting piece and the second connector piece, thereby to provide a seal in the open position of the second housing.

8. A transfer closure valve as claimed in claim 1, further comprising a seal in the region of the first connecting piece and a frusto-conical circumferential seal on the lifting cap for resting on the seal in the region of the first connecting piece.

* * * * *